United States Patent [19]

Veeder

[11] Patent Number: 5,075,048

[45] Date of Patent: Dec. 24, 1991

[54] GAS DIFFUSER DOME

[75] Inventor: Richard K. Veeder, Pittsford, N.Y.

[73] Assignee: Ferro Corporation, Cleveland, Ohio

[21] Appl. No.: 558,348

[22] Filed: Jul. 23, 1990

[51] Int. Cl.[5] ..... B01F 3/04

[52] U.S. Cl. ..... 261/122

[58] Field of Search ..... 261/122; 425/405.2, 425/423

[56] References Cited

U.S. PATENT DOCUMENTS

| | | | |
|---|---|---|---|
| 1,117,601 | 11/1914 | Porter | 261/122 |
| 2,218,635 | 10/1940 | Borge | 261/122 |
| 3,034,191 | 5/1962 | Schaefer et al. | 425/405.2 |
| 3,397,429 | 8/1968 | Zavitz et al. | 261/423 |
| 3,532,272 | 10/1970 | Branton | 261/122 |
| 3,753,746 | 8/1973 | Koerner | 261/122 |
| 3,978,176 | 8/1976 | Voegeli | 261/122 |
| 4,046,845 | 9/1977 | Veeder | 261/122 |
| 4,261,933 | 4/1981 | Ewong et al. | 261/122 |
| 4,788,023 | 11/1988 | Buhler et al. | 425/405.1 |
| 4,851,163 | 7/1989 | Stanton et al. | 261/122 |

FOREIGN PATENT DOCUMENTS

| | | | |
|---|---|---|---|
| 1149374 | 7/1983 | Canada | 261/122 |

*Primary Examiner*—Tim Miles

*Attorney, Agent, or Firm*—D. Peter Hochberg; Mark Kusner; Louis J. Weisz

[57] ABSTRACT

A cap-like gas diffuser that produces uniformly sized small bubbles, evenly distributed over the surface of the diffuser is produced by controlling the uniformity of compaction of the particulate material used to form the diffuser during its process of fabrication. Fabrication of the diffuser to provide specified ratios of plenum height to top wall thickness favorably influences attainment of compaction uniformity, as well as reduces diffuser surfaces that contribute to the formation of non-uniform bubbles. Diffusers of the invention made from particulate ceramics are especially useful in treating sewage using the activated sludge process.

6 Claims, 3 Drawing Sheets

GAS DIFFUSER DOME

TECHNICAL FIELD

This invention relates to air diffusers used in connection with the secondary treatment of sewage wastes. More particularly, this invention relates to porous diffusers used in the oxidative, biological treatment of sewage using the activated sludge process. Specifically, this invention relates to ceramic diffuser domes or caps that permit the generation of more uniformly sized and evenly dispersed bubbles in the treatment of sewage by controlling the degree of compaction of the particulates from which the domes are formed, and by desirably configuring the diffusion surface of the domes.

BACKGROUND OF THE INVENTION

Preservation of the environment is increasingly being recognized as of vital importance to society if its quality of life is to avoid destructive impairment. A vital part of this effort involves the treatment of human waste from an ever-increasing population, particularly in areas of high population density. Typically, the large scale processing of human sewage involves an initial primary treatment to remove solid wastes, followed by biological, or secondary treatment of the residual sewage. In course of the biological treatment, an oxidative process, pathenogenic contamination is reduced by controlling the conditions within the treatment area to favor the propagation of microorganisms that feed on, and thus destroy the sewage. The pathogens present are killed in the process, and the biological oxygen demand of the residuum is lowered to a point at which release of the treated material back into the environment results in minimal or no threat to the public health.

Typically, secondary treatment is accomplished by bubbling or diffusing air upward from the bottom of large aeration tanks in which the sewage is confined. The treatment tanks are long, deep, e.g., in the order 15 feet, tanks equipped for air sparge into their liquid contents from multiple air outlets located along their bottom.

As will be readily appreciated, the efficiency of the oxidative process depends to an important extent upon the degree of access of air to the aerobic organisms that populate the tank. In turn, such access is directly influenced by the nature and distribution of the bubbles traveling upward in the tank, being favored by many small uniformly dispersed bubbles providing a large surface area. Porous ceramic diffusers are well suited to the generation of such bubbles, typically 2 to 3 millimeters in diameter, and such fine bubble diffusers have heretofore enjoyed widespread use in the industry.

In the past, ceramic diffusers employed for this purpose have taken various forms. For example, the diffusers originally took the form of flat ceramic plates fastened to concrete "boxes" spaced along the bottom of the treatment tanks fed with air from manifold pipes located beneath the tanks. The fact that such systems were difficult to maintain and desirably modify, however, resulted in the development of alternative systems, for instance, ceramic diffuser tubes supplied with air fed from a manifold pipe system positioned along the tank's bottom. The diffusion of a gas through a cylindrical surface tends to result in the generation of non-uniform sized bubbles, however, due in part to the tendency of some of the bubbles generated on vertical surfaces to coalesce into bubbles of larger, varying sizes.

Circular air permeable diffuser discs of the type described in U.S. Pat. No. 4,046,845 have also been used, and while these are generally satisfactory, the amount of the air-filled space, or plenum, located immediately below the disc which is necessary to resupply air lost across the face of the diffusion surface as a consequence of bubble formation is dependant in such designs upon the geometry of the structural assembly upon which the diffusers are mounted. Consequently, a certain inflexibility is inherent in such systems, insofar as varying the amount of air that can be supplied to the diffusers through their associated plenums.

A further design is that comprising a diffuser cap or dome-shaped hollow enclosure contemplated by U.S. Pat. No. 3,532,272. The device there described involves a covered, cylindrically shaped enclosure, sealed around its lower perimeter to a manifold pipe from which it is supplied with air. While such domes inherently provide their own plenum structures, a significant drawback to their use has been the non-uniformity in both the size and distribution of the bubbles formed by use of the devices.

BRIEF DESCRIPTION OF THE INVENTION

In view of the foregoing therefore, it is a first aspect of this invention to provide air diffusers that are particularly useful in sewage treatment as a consequence of their superior ability to transfer oxygen to the sewage medium in which they are located.

A second aspect of this invention is to provide bubble diffuser domes capable of yielding uniformly small sized bubbles.

Another aspect of this invention is to provide bubble diffuser domes that produce small bubbles substantially evenly across their diffusion surfaces.

An additional aspect of this invention is to reduce the amount of coarse bubble diffusion surfaces frequently found in bubble diffusion domes of the prior art devices.

A further aspect of this invention is to provide specific ratios of plenum height to wall thickness in bubble diffuser domes.

Yet another aspect of this invention is to control the compaction of the particulate mixtures used to fabricate ceramic bubble diffuser domes during the pressing operation used in their formation.

Still a further aspect of this invention is to prepare bubble diffuser domes useful in activated sludge sewage processing by uniformly compacting particulate ceramic mixtures.

The preceding and additional aspects of this invention are provided by an improved gas diffuser comprising an enclosure defined by a wall that includes a top portion, and a side portion, said wall being gas permeable and said diffuser being adapted for sealing connection to a gas supply manifold, wherein the space within said enclosure forms a plenum chamber for gas passing outwardly through said wall from said manifold, and wherein said diffuser is formed by being pressed from particulate material in an operation in which the pressing is controlled so that the degree of compaction of the material forming the wall does not vary more than about 10% throughout said wall.

The preceding and still other aspects of the invention are provided by an improved air permeable diffuser comprising a circular ceramic, cap-like wall defining an enclosure, said wall being adapted for sealing connection to an air supply manifold, wherein the space within said enclosure forms a plenum chamber for air passing outwardly through said wall from said manifold, and wherein the air permeability throughout said wall is made substantially uniform by pressing the diffuser from particulate material comprising a mixture of fused aluminum oxide grit with a fusible bond material in a pressing operation in which the pressing is controlled so that the degree of compaction of said material does not vary more than about 10% substantially throughout said wall.

BRIEF DESCRIPTION OF THE DRAWINGS

The invention will be better understood when reference is had to the following drawings, in which like-numbers indicate like-parts, and in which.

DETAILED DESCRIPTION OF THE INVENTION

Figure 1:
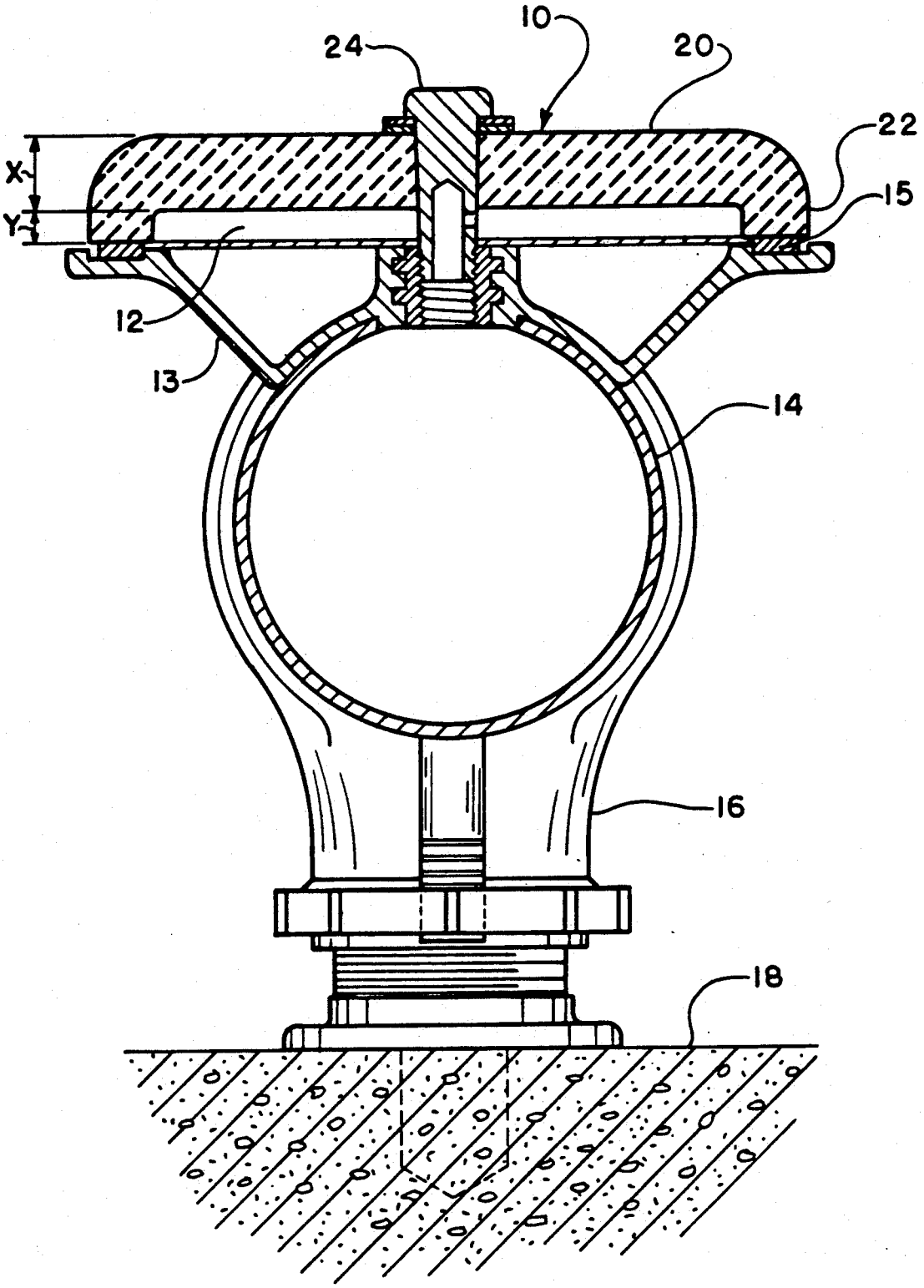
FIG. 1 is a cross-sectional view through the vertical center of a circular diffuser dome of the invention mounted on an air manifold.

FIG. 1 shows a cross-sectional view through the vertical center of a circular diffuser dome of the invention, generally 10, mounted on an air manifold 14. As shown, the dome 10 comprises a circular cap-like enclosure having a top portion 20 and a side portion 22, the dome resting upon a gasket 15, supported by an attachment yoke 13 held by an air manifold 14. The dome 10 is secured to the manifold assembly by means of a hold-down bolt 24, while the manifold itself is anchored to the floor of the treatment tank 18 by means of a manifold support 16.

Dome caps of the type described in the preceding are fabricated from a mixture of ingredients in particulate form. In the case of ceramic domes diffusers, the particulate mixture comprises a combination of fused aluminum oxide with a "bond" material. Typically, the fused aluminum oxide will comprise about 80% to 90%, by weight, of the mixture with about 85% being common, while the bond material will constitute about 10% to 20% of the mixture, about 15% being usual.

The fused aluminum oxide is employed in the form of a grit having a size designation of 36, 46, 54, 60, 70, 80, 90, and100, or mixture of such sizes as defined by the American National Standards Institute. An example of such material useful in manufacturing diffuser domes is that sold as brown or white fused aluminum oxide by Washington Mills Abrasive Company.

The bond material is a fusible mixture of some or all of aluminum silicate clay, flux (feldspar), and frit (powdered glass). The clay, or "ball clay" as it is sometimes referred to, is typified by that marketed by the Kentucky-Tennessee Clay Company, while the feldspar, in powdered form, is exemplified by that manufactured by the Feldspar Corporation as their product "C-6". Among other products, a suitable frit, in the form of powdered glass, is that marketed by the Ferro Corporation as their product number 3110.

In the process of manufacturing the diffuser domes, there may be employed a male/female die assembly operative within a cylindrical wall. In the die stamping or pressing process, the male portion of the die will typically be positioned at the bottom of the cylinder, the latter then being filled with the particulate mixture. Subsequently, the female portion of the die is inserted in the top of the cylinder, and the contents of the cylinder are compressed to the desired pressure. Prior to its compaction, as described, the particulate mixture is moistened with water, for instance, by the addition of up to about 4% to 6% by weight of water, based on the mixture being pressed.

Following fabrication as described, the newly-formed diffuser dome is removed from the press, dried in air or in an oven until it can be readily handled, and then fused in a kiln at from about 2000° to 2400° F.

As will be described in more detail in connection with FIG. 2A, diffuser domes of the prior art are inclined to be more tightly compacted in the top portion thereof, as shown by 20, in FIG. 1, than in their side portion 22. This tends to result in the diffusion of air through the side portion, in preference to the top portion. Not only does this result in the uneven generation of bubbles across the surface of the diffuser dome, but it encourages the formation of bubbles along the vertical surface of the side portion. As previously explained, bubbles rising along a vertical surface tend to undesirably coalesce into bubbles having widely varying dimensions. Thus the prior art dome devices encourage bubble formation at the worst-possible location.

The diffusion dome of the invention overcomes the disadvantages described by evenly adjusting the degree of compaction across the entire surface of the diffuser, including both the top and side portions, within a relatively narrow range. In addition, the diffusers of the invention are fabricated so that the ratio of the plenum height, "y" in FIG. 1, to the thickness of the top portion "x" in the Figure is controlled within a specific range. By controlling such ratio, it has been discovered that not only is the vertical surface of the diffuser desirably reduced, minimizing the coalescing phenomenon referred to, but the compaction throughout both the side portion and the top portion of the diffuser tends to be more uniform. Thus when both variables are suitably controlled, not only are the bubbles generated more uniformly sized, but they are typically more evenly distributed across the surface of the diffuser.

In the above connection, it has been found desirable to fabricate dome diffusers of the type described so that the ratio of the height of their plenum to the thickness of the wall of their top portion is in the range of from 0.30 to about 0.07. Surprisingly, when the diffuser domes are fabricated as described to have the ratio indicated, it has been found that the degree of compaction of the dome substantially across its entire surface, including both the top and side portions thereof, will vary by less then about 10%. Furthermore, it has been determined that when the compaction ratio across the surface of the diffuser, does not vary by more than about 10%, the distribution of bubbles across the surface will be relatively even, favoring superior oxidative treatment of sludges.

Therefore, while control of the degree of compaction can by itself greatly contribute to the uniformity of bubble dispersion, and consequently provide a means for enhancing desirable small bubble formation, the shortening of the side portions through adjustment of the ratio described furnishes another means by which bubble formation can be markedly improved. In a preferred embodiment of the invention, both the degree of the compaction and ratio are adjusted within the limits indicated.

Figure 2A:
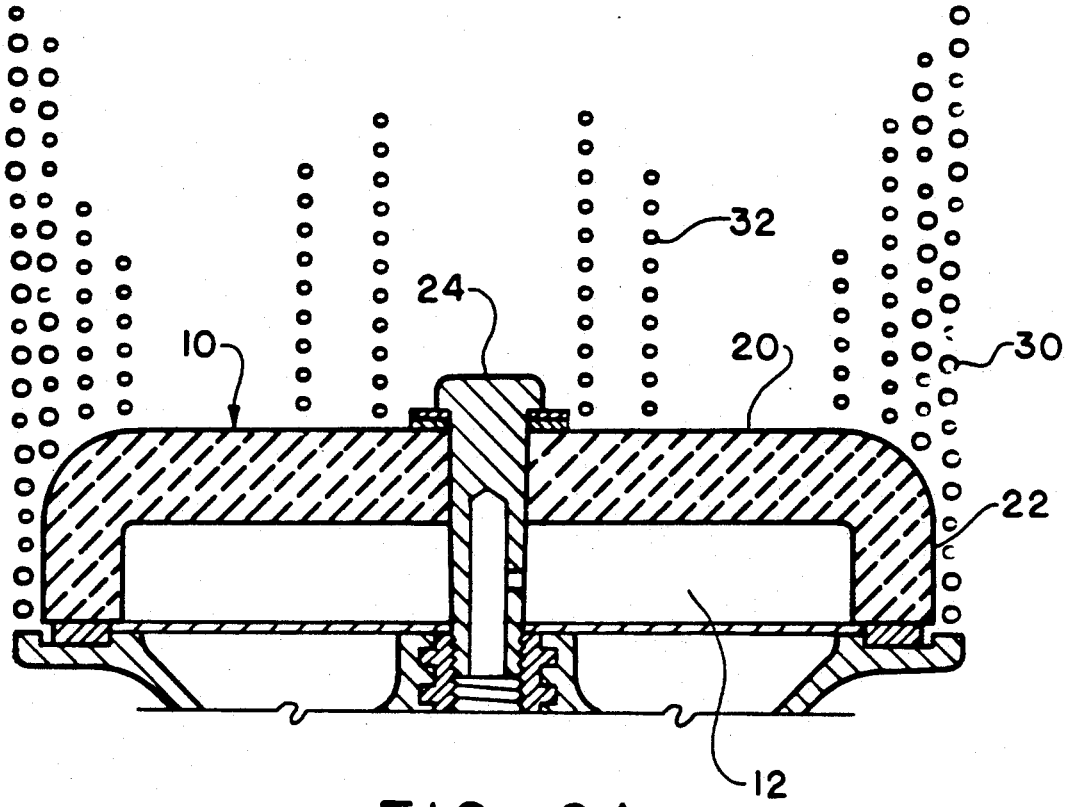
FIG. 2A is a semi-schematic, cross-sectional view of a diffuser dome of the prior art illustrating the relative size and distribution of gas bubbles emanating therefrom.

FIG. 2A is a semi-schematic, cross-sectional view of a diffuser dome of the prior art illustrating the relative size and distribution of bubbles generated thereby. In the Figure, the diffuser 10 with its hold-down bolt 24 is shown. The diffuser comprises a cap-like structure having a side portion 22, as well as a top portion 20, the whole enclosing a plenum area 12. As can be seen, the side portion comprises a vertical surface along which the bubbles formed thereon tend to coalesce to form bubbles of varying size 30. While the balance of the bubbles 32 are substantially uncoalesced, it is apparent that relatively more bubbles are formed toward the side portion of the diffuser then in the center, for example, in the vicinity of the hold-down bolt. This may be attributed to the fact that the relatively severe compaction required to form the relatively high plenum area 12 has resulted in a less porous top portion 20, than its adjoining side portion 22.

Figure 2B:
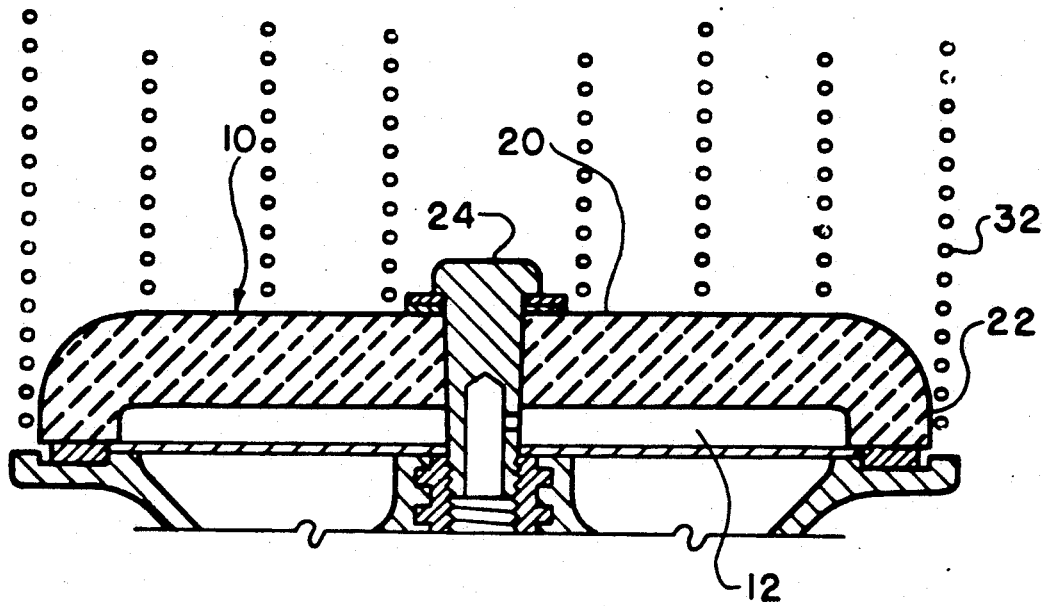
FIG. 2B is a semi-schematic, cross-sectional view of a diffuser dome of the invention illustrating the more uniform size and improved distribution of small bubbles emanating therefrom.

In sharp contrast is FIG. 2B which shows a semi-schematic, cross-sectional view of a diffuser dome of the invention, illustrating the more uniformly sized and improved distribution of bubbles being formed thereon. In the Figure, formation of the diffuser dome with a plenum 12, relatively low in height compared to the thickness of the top portion 20, has not only produced a diffuser with a shortened side portion 22, but has provided an overall diffuser surface, including both the side and top portions, having a substantially uniform degree of compaction. The effect of the shortened side portion is to minimize the formation of varying sized coalesced bubbles, while even compaction of the diffuser in both its top and side portions produces a more uniform distribution of the bubbles 32 across the entire diffuser.

Figure 3:
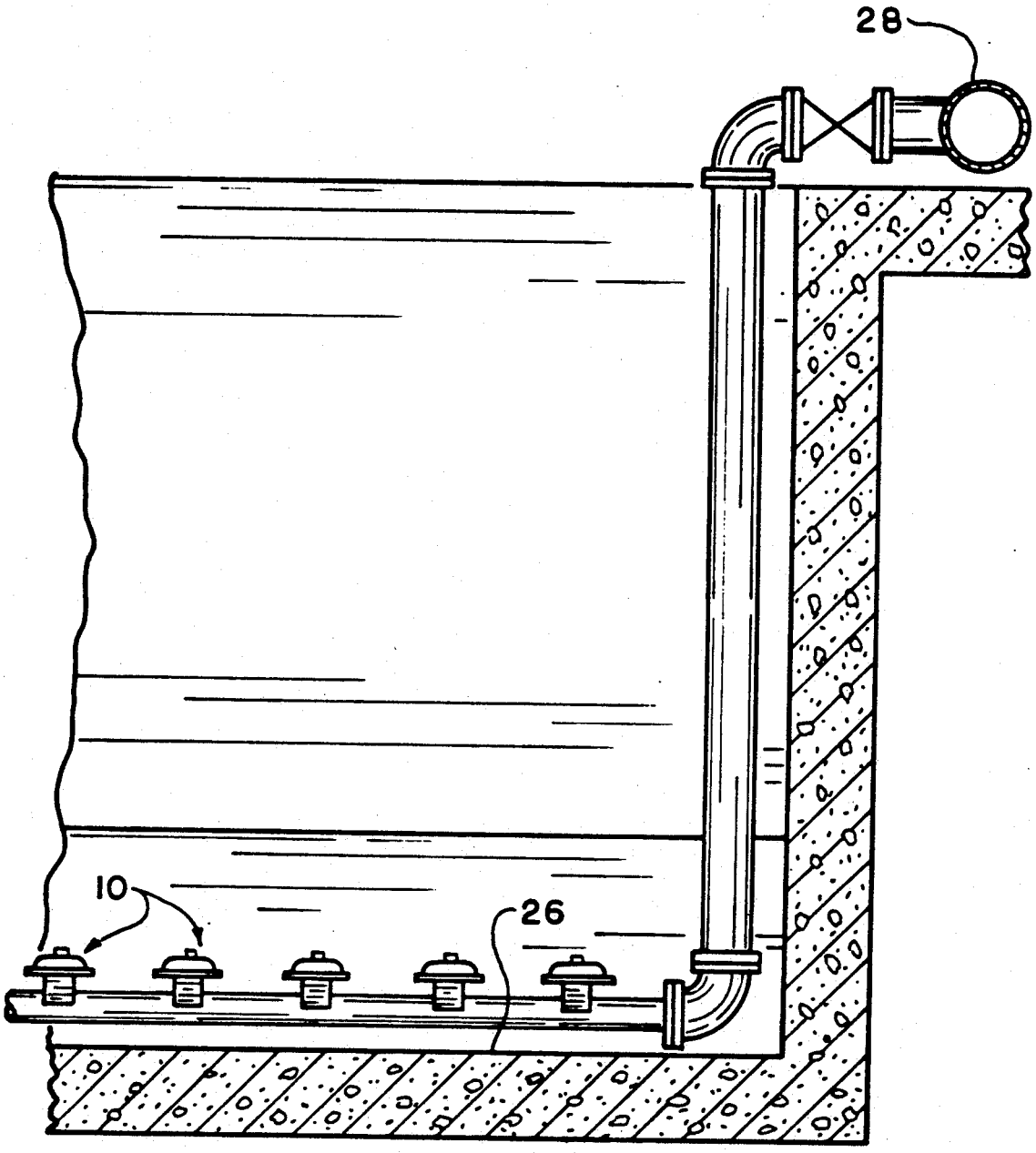
FIG. 3 is a partial view of an array of diffuser domes of FIG. 1 mounted in the bottom of an activated sludge tank.

FIG. 3 is a partial view of an array of the diffuser domes of FIG. 1 mounted in the bottom of an activated sludge tank. In the Figure, a number of diffuser domes 10 are located on the bottom of sludge tank 26, connected to a manifold supply line 28.

Although their dimensions may be widely varied, commonly, the diffuser domes of the invention will comprise cap-like structures, which may be in the order of 6 to 8 inches in diameter, having a plenum height of about ⅛ to ¼ inch, while the side and the top portion thicknesses will be about ½ to ¾ inch.

Although circularly shaped diffusers are convenient in many instances, the diffusers may also be rectangular, including square; shallow conical or spherical; cap or dome-like; stepped, or they can be fabricated in other shapes.

In addition, while porous ceramic materials have typically been used to fabricate diffuser domes of the invention, porous metals and plastics may also be used. Porous metals can include stainless steels, non-ferrous metals, their alloys, and the like. Among suitable plastics may be mentioned porous thermoplastics including PVC, polyamides, polyacrylates, and others.

Ordinarily, diffusers of the invention will be used in connection with air flow rates ranging from ¾ to 1¼ cubic feet per minute, a flow rate of about 1 cubic foot per minute being typical.

While in accordance with the patent statutes, a preferred embodiment and best mode has been presented, the scope of the invention is not limited thereto, but rather is measured by the scope of the attached claims.

What is claimed is:

1. An improved gas diffuser comprising an enclosure defined by a wall that includes:

a top portion, and a side portion.

said wall being gas permeable and said diffuser being adapted for sealing connection to a gas supply manifold, wherein the space within said enclosure forms a plenum chamber for gas passing outwardly through said wall from said manifold, and wherein said diffuser is formed from particulate material wherein the degree of compaction of the material forming said wall does not vary more than about 10% throughout said wall in which the ratio of the height of said plenum to the thickness of said top portion is no more than about 0.30.

2. A gas diffuser element according to claim 1 wherein said member is a particulate ceramic material.

3. A gas diffuser according to claim 2 wherein said particulate material comprises a mixture of aluminum oxide grit and a bond material containing fusible members selected from the group of an aluminum silicate clay, feldspar, and frit, and wherein said particulate material is fused following its compaction.

4. An improved gas diffuser comprising an enclosure defined by a wall that includes:

a top portion, and a side portion, said wall having a thickness of from about ½ to about ¾ inch, being gas permeable, and said diffuser being adapted for sealing connection to a gas supply manifold, wherein the space within said enclosure forms a plenum chamber having a height of from about ⅛ to about ¼ inch for gas passing outwardly through said wall from said manifold, and wherein said diffuser is formed from particulate material, and wherein further the degree of compaction of the material forming said wall does not vary more than about 10% throughout said wall.

5. A gas diffuser according to claim 4 in which said wall is air permeable.

6. A gas diffuser according to claim 4 wherein said enclosure has a circular cap-like shape.

* * * * *